US012188748B1

(12) United States Patent
Zelenka et al.

(10) Patent No.: US 12,188,748 B1
(45) Date of Patent: Jan. 7, 2025

(54) ADJUSTABLE BOW SIGHT

(71) Applicant: Lakeshore Shooting Sports, LLC, West Olive, MI (US)

(72) Inventors: Timothy John Zelenka, West Olive, MI (US); Jeffrey Paul Kunkle, Allegan, MI (US)

(73) Assignee: Lakeshore Shooting Sports, LLC, West Olive, MI (US)

( * ) Notice: Subject to any disclaimer, the term of this patent is extended or adjusted under 35 U.S.C. 154(b) by 256 days.

(21) Appl. No.: 17/343,468

(22) Filed: Jun. 9, 2021

Related U.S. Application Data

(60) Provisional application No. 63/102,406, filed on Jun. 15, 2020.

(51) Int. Cl.
*F41B 5/14* (2006.01)
*F41G 1/34* (2006.01)
*F41G 1/38* (2006.01)

(52) U.S. Cl.
CPC ..... *F41G 1/38* (2013.01); *F41G 1/345* (2013.01); *F41B 5/14* (2013.01)

(58) Field of Classification Search
CPC ... F41B 5/14; F41G 1/38; F41G 1/467; F41G 1/033; F41G 1/16; F41G 1/20; F41G 1/24
USPC ..... 124/80
See application file for complete search history.

(56) References Cited

U.S. PATENT DOCUMENTS 2,559,927 A * 7/1951 Beloungy ..... F41G 1/467 33/265
2,654,152 A * 10/1953 La Vire ..... F41G 1/467 33/265
4,237,615 A * 12/1980 Bracknell ..... F41G 1/467 33/265
4,291,469 A * 9/1981 Weast ..... F41G 1/467 124/87
4,294,017 A * 10/1981 Byrnes ..... F41G 1/467 33/265
4,995,166 A * 2/1991 Knemeyer ..... F41G 1/467 33/265
5,092,053 A * 3/1992 Roberts ..... F41G 1/467 124/87
5,802,726 A * 9/1998 Trosper, Jr. ..... F41G 1/467 124/87
6,922,900 B1 * 8/2005 Henry ..... F41G 1/467 124/87
9,285,188 B1 * 3/2016 LoRocco ..... F41G 1/345
9,772,165 B1 * 9/2017 Johnson ..... F41G 1/467
9,810,504 B1 * 11/2017 LoRocco ..... F41B 5/14
2011/0271944 A1 * 11/2011 Haney ..... F41B 5/1434 124/87

(Continued)

*Primary Examiner* — John E Simms, Jr.
(74) *Attorney, Agent, or Firm* — Larry E. Henneman, Jr.; Henneman & Associates, PLC

(57) ABSTRACT

An adjustable bow sight includes a base, a sight mount, a carrier, and an adjustment mechanism. The base is configured to be mounted to the riser of a bow. The sight mount is configured to facilitate the mounting of a sight to the carrier. The carrier is configured to move with respect to the base but remain fixed with respect to the sight. The adjustment mechanism facilitates the adjustment of the position of the carrier with respect to the base. In a particular embodiment, the carrier moves along an arcuate path when the adjustable bow sight is adjusted. In a more particular embodiment, the sight is a scope.

14 Claims, 19 Drawing Sheets

(56) References Cited

U.S. PATENT DOCUMENTS

| | | | | |
|---|---|---|---|---|
| 2015/0082643 | A1* | 3/2015 | Summers | F41G 1/467 33/265 |
| 2015/0135579 | A1* | 5/2015 | Summers | F41G 1/467 42/130 |
| 2016/0059628 | A1* | 3/2016 | Degrace | B60B 33/0068 16/35 R |
| 2018/0045488 | A1* | 2/2018 | Hamm | F41G 1/40 |
| 2019/0346236 | A1* | 11/2019 | Hollars | F41G 1/467 |
| 2019/0390937 | A1* | 12/2019 | Mason | F41G 1/467 |
| 2022/0316841 | A1* | 10/2022 | Mason | F41G 1/467 |

* cited by examiner

ADJUSTABLE BOW SIGHT

RELATED APPLICATIONS

This application claims the benefit of priority of U.S. Provisional Patent Application Ser. No. 63/102,406, filed Jun. 15, 2020 by the same inventors and entitled "Adjustable Mount For A Red Dot Scope Which Moves On An Arc Design For A Bow," which is incorporated by reference herein in its entirety.

BACKGROUND OF THE INVENTION

Field of the Invention

This invention relates generally to archery, and more particularly to sight systems for bows.

Description of the Background Art

Most modern bows are adapted to receive some sort of sight to facilitate aiming. Such sights are typically bolted to the bow riser, just above an arrow rest which is also bolted to the bow riser. There are various types of bow sights available on the market today such as, for example, open pins, lighted scopes, magnified scopes, etc.

Most sights are configured to accommodate varying target distances. For example, many of these sights include multiple fixed pins and/or fixed reticles disposed in a vertical column such that each is designated for a different target distance. There are many challenges associated with multi-pin and multi-reticle sights. For example, each discrete pin has to be individually sighted in. Of course, the process of sighting in multiple pins and/or reticles is time consuming and tedious. As another example, multiple pins equates to multiple potential points of failure.

In effort to overcome the aforementioned problems associated with multi-pin/reticle sights, many single pin/reticle sights have been developed. Such sights typically include an adjustable mechanism for adjusting the vertical position of the pin/reticle with respect to the bow riser along a vertical path. There are also disadvantages to current single pin/reticle sights. For example, changing the vertical height of the sight/reticle slightly changes the archer's perspective of the pin/reticle. This is particularly undesirable with magnified scopes because the optical axis of the archer's eye must remain aligned with the optical axis of the scope. Otherwise, the scope will appear blacked out. In order to prevent a blacked out scope, the archer is forced to compensate by moving the position of their eye with respect to the bow. However, moving the position of the archer's eye with respect to the bow violates a fundamental principle of archery that the draw position of the archer with respect to the bow should be as consistent as possible with every shot, regardless of the target distance.

SUMMARY

The present invention overcomes the problems associated with the prior art by providing an adjustable sight mount that maintains alignment of the sight with the archer's line of sight, without requiring the archer to change his/her draw position. In addition, when used in combination with some sights (e.g., red dot scopes), the sight alignment remains accurate, even if the archer does change draw/eye position.

An example adjustable bow sight mount includes a base, a sight mount, a carrier, and an adjustment mechanism. The base is configured to be coupled to a riser of a bow in a fixed position with respect to the riser, and the base defines a base axis extending in a direction corresponding to an initial trajectory of an arrow shot from the bow. The sight mount is configured to facilitate the attachment of a sight thereto, and the sight mount at least partially determines a position of a line of sight through the sight. The carrier is movably coupled between the base and the sight mount. The adjustment mechanism is configured to facilitate the selective movement of the carrier with respect to the base, which results in a change of relative alignment between the base axis and the line of sight.

In an example adjustable bow sight mount, the adjustment mechanism includes a rack gear and a pinion gear. The rack gear is fixed to the carrier, and the pinion gear is rotatable about an axis that is fixed with respect to the base. The adjustment mechanism can also include an adjustment knob. The pinion gear can be fixed to the adjustment knob, and the carrier moves with respect to the base responsive to rotating the adjustment knob.

In an example adjustable bow sight, one of the base and the carrier can include a guide. The other of the base and the carrier can include a follower configured to mate with the guide. The guide and the follower, together, can direct the carrier along a path with respect to the base. At least one of the guide and the follower can include a track extending along the path, and the path can be curved. In a particular example adjustable bow sight, the path has a radius of curvature that is greater than a largest dimension of the adjustable bow sight.

In an example adjustable bow sight, the carrier can be selectively movable between a plurality of spaced-apart, discrete positions with respect to the base. One of the carrier and the base can include a detent, and the other of the carrier and the base can include a plurality of valleys positioned and configured to selectively engage the detent. Each valley of the plurality of valleys can correspond to a respective one of the spaced-apart, discrete positions.

In an example adjustable bow sight, the carrier can be configured to move along a curved path with respect to the base. The curved path can have a radius of curvature corresponding to an average draw length of a number of adult bows.

In an example adjustable bow sight, the base can include a plurality of countersunk holes. The countersunk holes can be configured to receive a respective plurality of countersunk screws. The plurality of countersunk screws can be configured to thread into a respective plurality of threaded holes formed in the riser of the bow, such that the heads of the countersunk screws do not protrude from the surface of the riser and interfere with the operation of the example adjustable bow sight.

In an example adjustable bow sight, the sight mount can include at least one scope ring mounted to the carrier, and the sight can be a scope. The sight mount can include a first scope ring and a second scope ring. The riser of the bow can be disposed between the first scope ring, the second scope ring, the base, and the scope when the base is mounted to the bow.

In an example adjustable bow sight, the adjustment mechanism can include a shaft, a knob, a pinion gear, and a rack gear. The shaft can extend along a shaft axis. The shaft can be fixed to the base and can remain stationary with respect to the base when the carrier is moved along a path with respect to the base. The knob can be coupled to the shaft, and the knob can be rotatable about the shaft axis. The pinion gear can be fixed to the knob. The rack gear can be fixed to the carrier and can be configured to mesh with the pinion gear. The carrier and the rack can advance along the path in a forward direction responsive to rotating the pinion gear clockwise about the shaft axis, and the carrier and the rack can advance along the path in a reverse direction responsive to rotating the pinion gear counterclockwise about the shaft axis.

An example adjustable bow sight can additionally include a guide coupled between the base and the carrier. The guide can have a first portion and second portion. The first portion of the guide can be coupled to the base, and the second portion of the guide can be being coupled to the carrier. The second portion of the guide can be configured to slidably engage the first portion of the guide, and the guide can direct the carrier along a path with respect to the base. Optionally, the first portion of the guide can be formed integrally with the base, and the second portion of the guide can be formed integrally with the carrier.

An example adjustable bow sight can additionally include a locking mechanism configured to selectively transition between a locked position and an unlocked position. The position of the pinion gear can be fixed with respect to the rack gear when the locking mechanism is in the locked position, and the pinion gear can be free to rotate about the shaft axis when the locking mechanism is in the unlocked position. In a particular example adjustable bow sight, the locking mechanism can include a cam, a pin, and a biasing member. The pin can be seated in a bore in the knob. The cam can include a handle end and a cam surface. The handle end can facilitate rotation of the cam by a user, and the cam surface can urge against an end of the pin. The biasing member can urge the pin into a retracted position within the bore. Rotation of the cam can urge the pin into an extended position from the bore and into a complementary bore in the base, thereby preventing rotation of the knob with respect to the base.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing an adjustable bow sight mount that is adjustable along a path that can be curved. In the following description, numerous specific details are set forth (e.g., material types, manufacturing process, etc.) in order to provide a thorough understanding of the invention. Those skilled in the art will recognize, however, that the invention may be practiced apart from these specific details. In other instances, details of well-known manufacturing practices (e.g., milling, turning, etc.) and components have been omitted, so as not to unnecessarily obscure the present invention.

Figure 1:
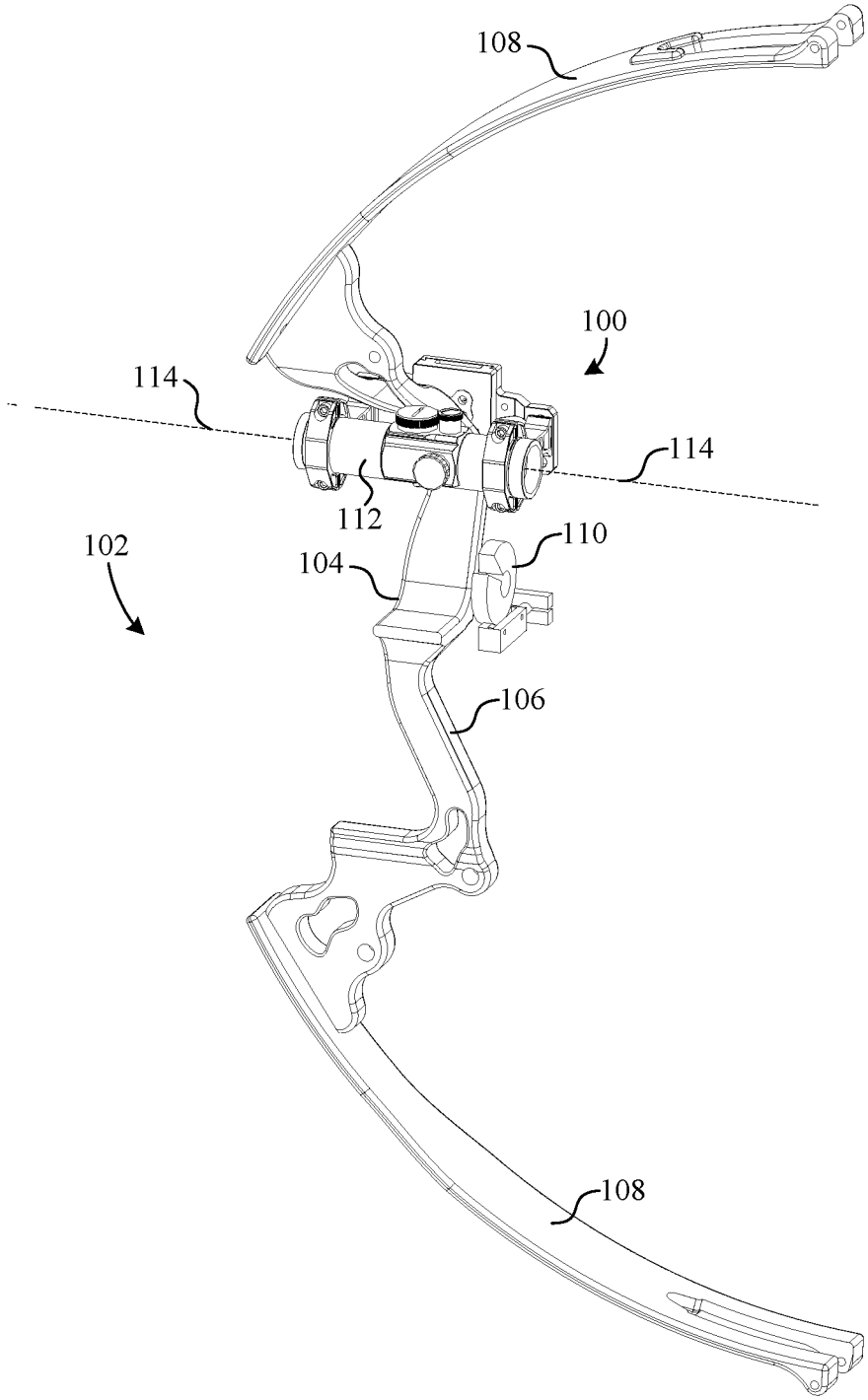
FIG. 1 is a first-side perspective view of an adjustable bow sight mounted to a bow.

FIG. 1 shows a perspective view of an adjustable bow sight 100 mounted to a compound bow 102. In this example, bow 102 is depicted as a compound bow without cams, wheels, cables, and strings. Those skilled in the art, however, will understand that these particular components of the host bow are not particularly relevant to the present invention and are, therefore, are not included in the drawings and accompanying description. Bow sight 100 is configured to mount many different types of bows including, but not limited to, recurve bows, compound bows, and so on. Bow 102 includes a riser 104, a handle 106, a set of limbs 108, and an arrow rest 110. Each of limbs 108 is mounted to a respective opposite end of riser 104. Arrow rest 110 is mounted to riser 104, between handle 106 and bow sight 100.

The risers of most modern bows include various threaded mounting holes for mounting various bow-mountable accessories (i.e., stabilizers, sights, arrow rests) thereto. Typically, the specifications of such mounting holes follow standards such as, for example, Archery Manufacturers Organization (AMO) standards. Such standards define the threaded mounting holes that facilitate the attachment of a bow sight to a bow riser as follows. The two holes located on the outside of the bow window are to be 10-24 threaded holes spaced 1.312+−0.010 center to center. Minimum thread depth shall be 0.250. Mounting holes in sights of other side mounting accessories should conform to these dimensions. A line through the axis of the holes shall be parallel to the bow string.

Of course, there are also some bow manufacturers that deviate from AMO standards and only accept accessories that correspond with their unique specifications. Those skilled in the art should recognize that the adjustable bow sight 100 of the present invention need not necessarily be limited to any specific standards. As will be discussed with reference to upcoming figures, adjustable bow sight 100 is configured to mount to bows that follow AMO standards and also bows that deviate from such standards.

In this example, bow sight 100 is equipped with a scope 112 having an optical axis 114. When the target distance changes, bow sight 100 is adjusted by changing the position of scope 112 with respect to riser 104 and, therefore, the orientation of optical axis 114 with respect to riser 104. For example, if the target distance increases, scope 112 is adjusted to point more downward with respect to riser 104. This causes riser 104 to point more upward when optical axis 114 is centered on the target. Oppositely, if the target distance degreases, scope 112 is adjusted to point more upward with respect to riser 104. This causes riser 104 to point more downward when optical axis 114 is centered on the target.

Figure 2:
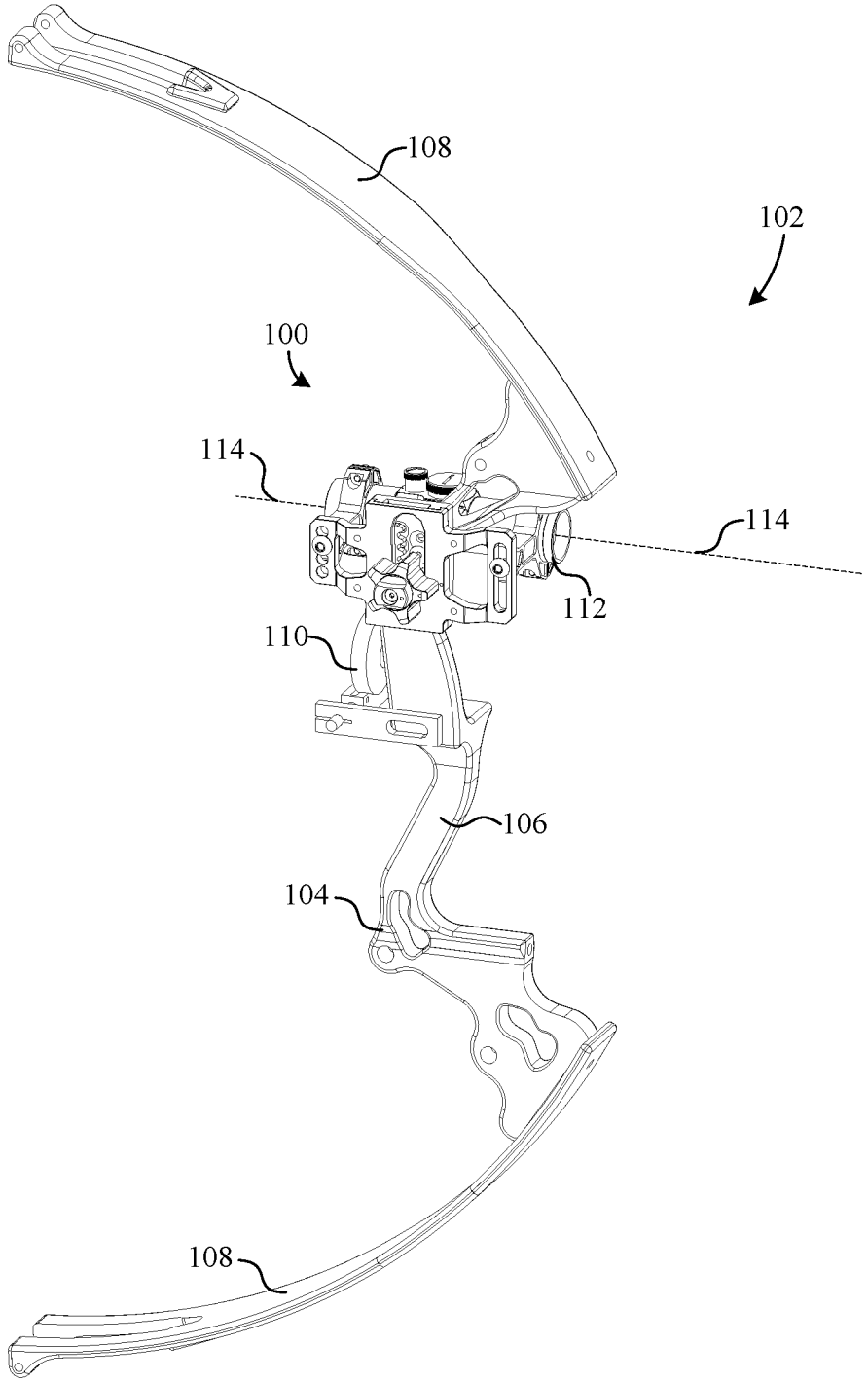
FIG. 2 is a second-side perspective view of the adjustable bow sight and bow of FIG. 1.

FIG. 2 shows another perspective view of adjustable bow sight 100 mounted to compound bow 102. In this example, bow 102 is a right-handed bow. That is, the archer grasps handle 106 with their left hand and draws the bow string (now shown) with their right hand. In addition to drawing the bow string with the right hand, the right-handed archer may also make adjustments to bow sight 100 with their right hand while holding handle 106 in the left hand. It should be understood that adjustable bow sight 100 may also be mounted on a left-handed bow. When mounted on a left-handed bow, the archer would grasp handle 106 with their right hand and make adjustments to bow sight 100 with their left hand.

Figure 3:
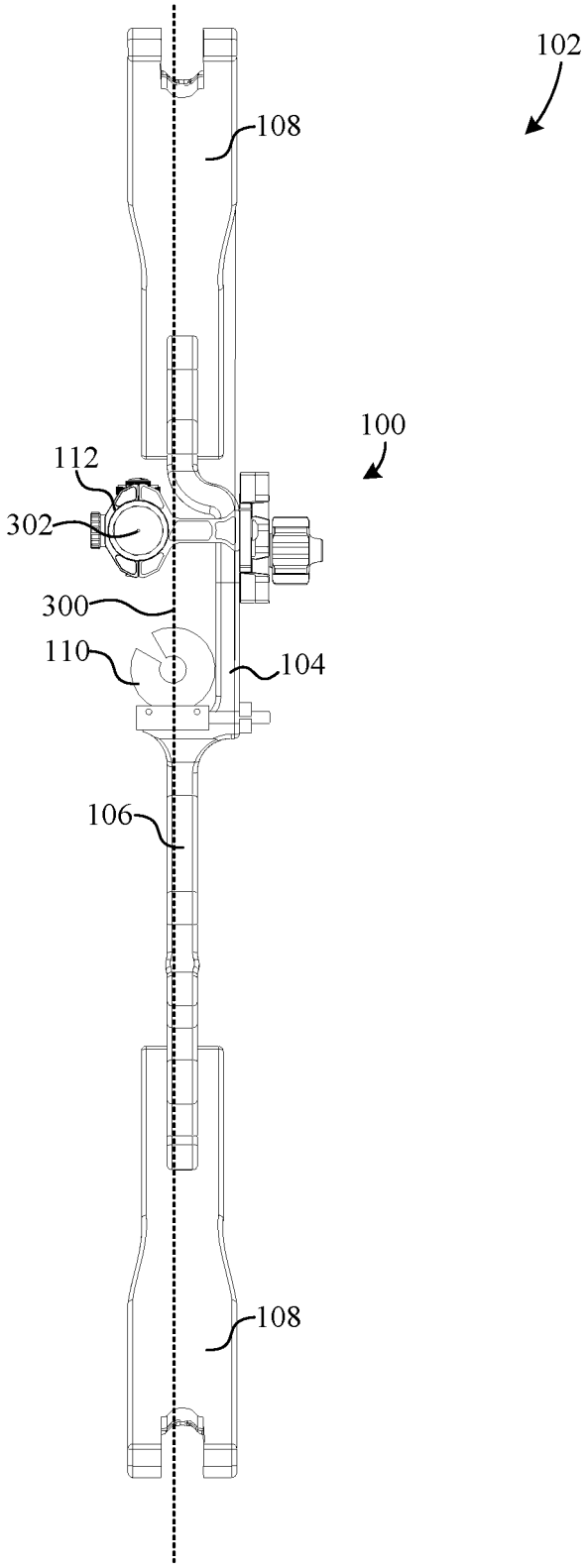
FIG. 3 is a rear plan view of the adjustable bow sight and bow of FIG. 1.

FIG. 3 shows a rear plan view of adjustable bow sight 100 mounted to compound bow 102. Line 300 represents a side view of the plane through which the string of bow 102 travels when it is released during a shot. As shown, arrow rest 110 is properly tuned horizontally such that line 300 is centered with respect to the center of arrow rest 110. As a result, the arrow will remain horizontally aligned with line 300 during flight. Unlike traditional bow sights, the reticle 302 of scope 112 need not necessarily be aligned with line 300 as shown. This is because scope 112 is a "red dot" scope. Red dot scopes include a wide variety of scopes wherein a dot (red, green, or any other color) or other indicator is projected onto the sight picture the shooter views through the scope. Types of red dot scopes include, but are not limited to, reflex, prism, holographic, and so on. In this example embodiment, adjustable bow sight 100 does not require a feature for horizontally adjusting the position of scope 112 with respect to riser 104. However, adjustable bow sight 100 can optionally include a horizontal adjustment feature such as, for example, scope rings with adjustable lengths.

Figure 4:
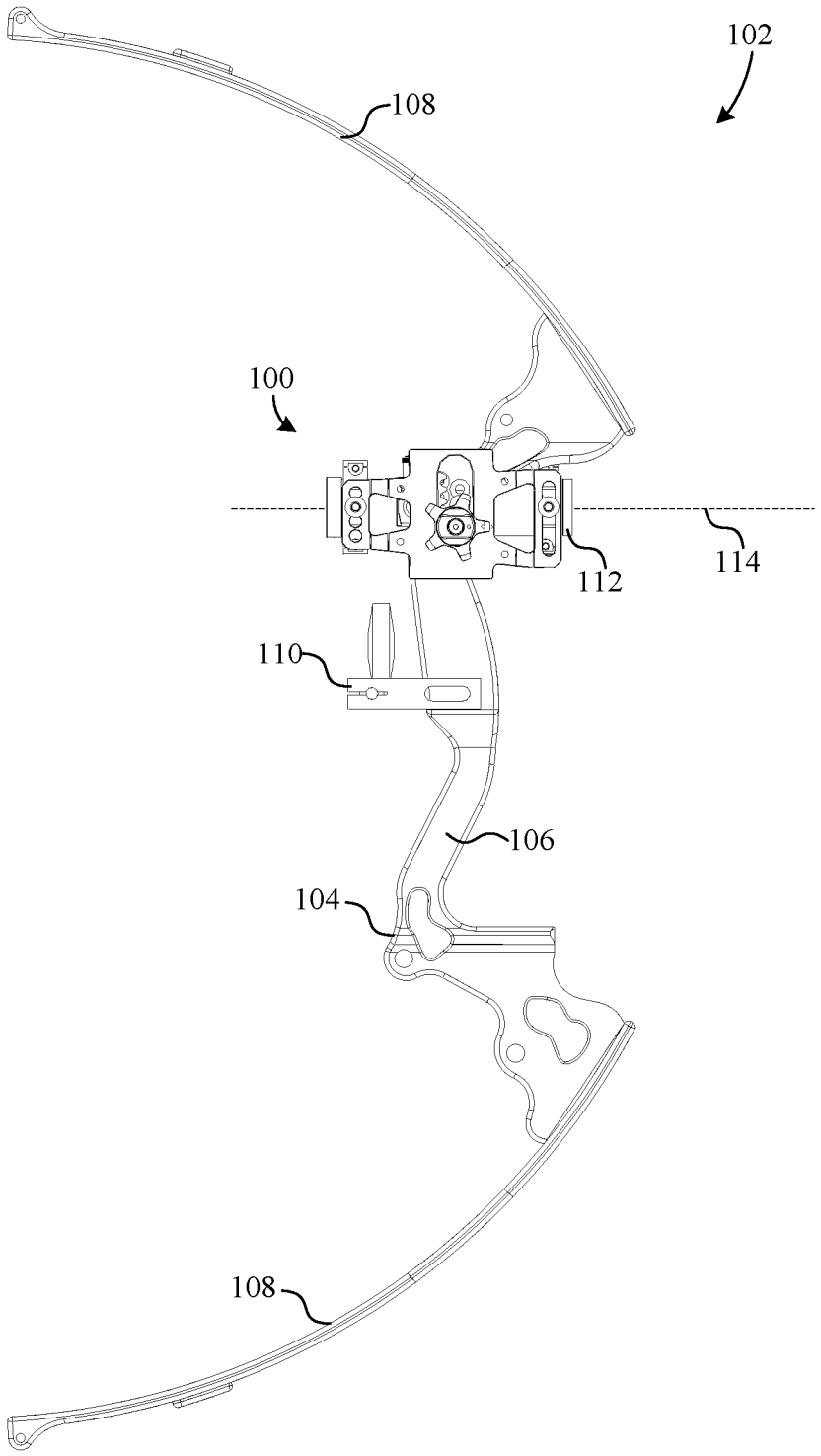
FIG. 4 is a side plan view of the adjustable bow sight and bow of FIG. 1.

FIG. 4 is a side plan view of adjustable bow sight 100 mounted on bow 102. The features of adjustable bow sight 100 will be described in greater detail with reference to the figures of the drawings that follow.

Figure 5:
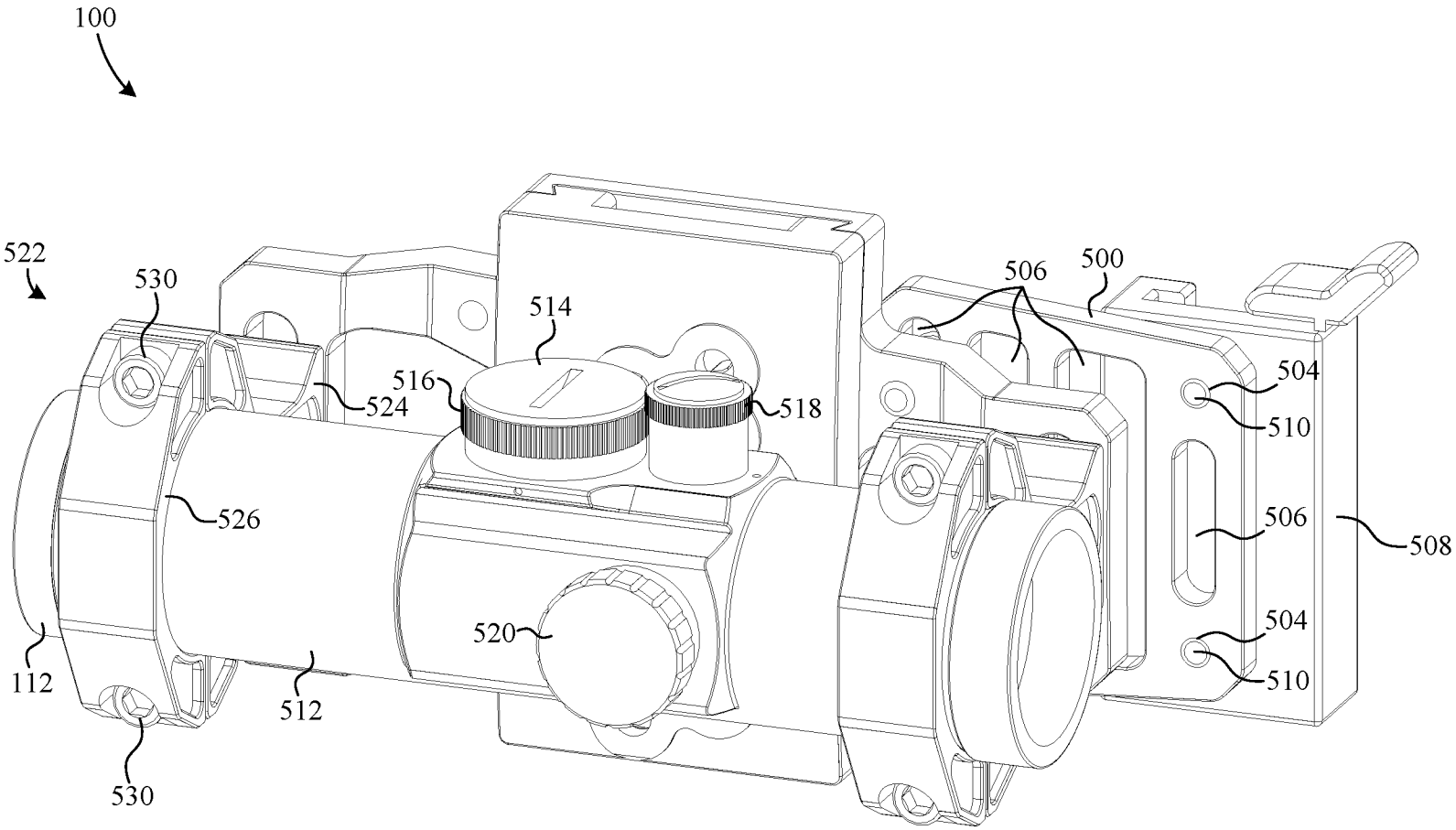
FIG. 5 is a first-side perspective view of the adjustable bow sight of FIG. 1.
Figure 6:
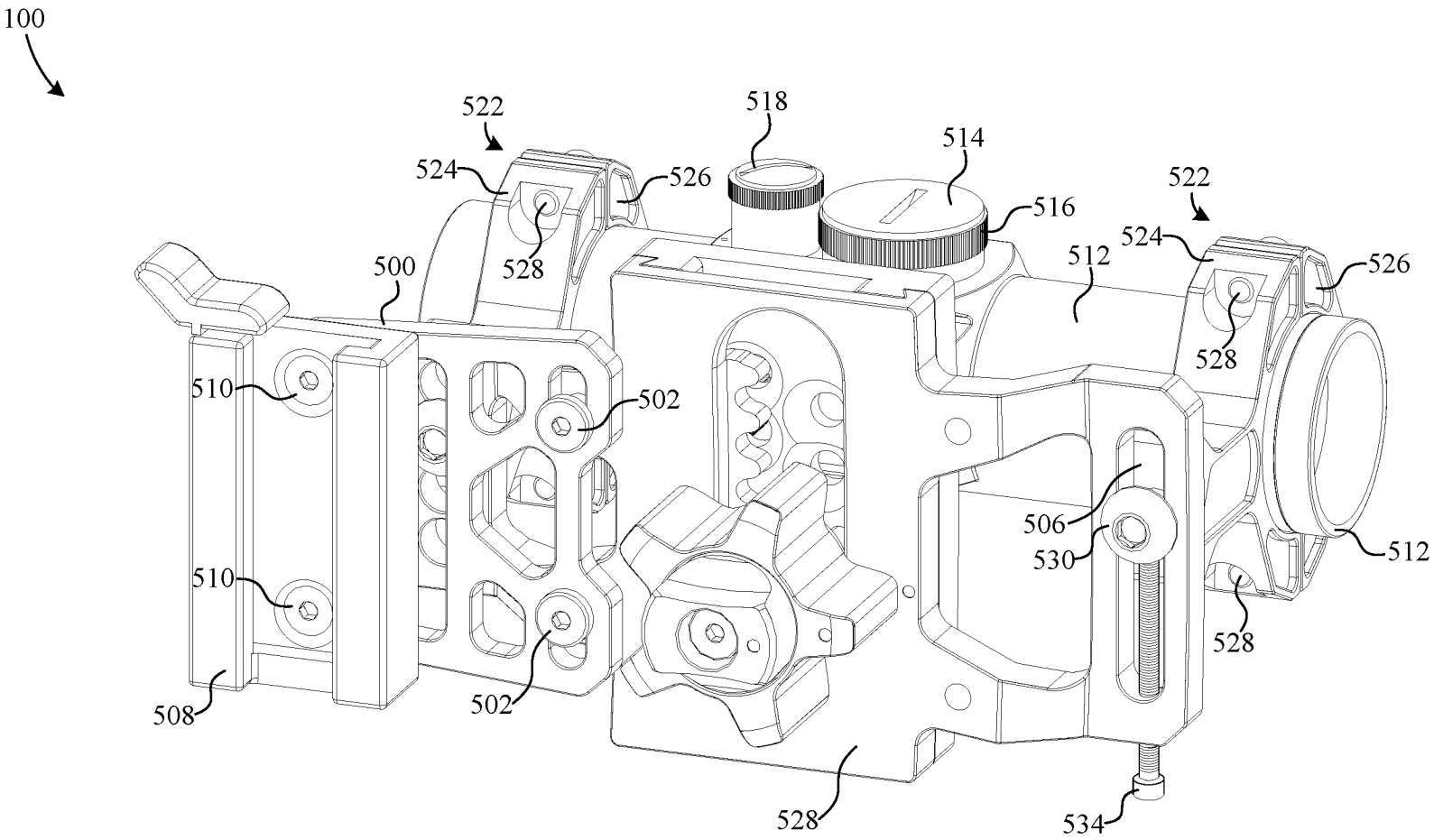
FIG. 6 is a second-side perspective view of the adjustable bow sight of FIG. 1.

FIGS. 5 and 6 are a first-side perspective view and a second-side perspective view, respectively, of adjustable bow sight 100 removed from bow 102. In this particular example, adjustable bow sight 100 includes an optional bracket 500, mounted thereto by a set of screws 502. Bracket 500 defines various mounting features including various screw holes 504 and slots 506 that facilitate the mounting of additional accessories thereto. For example, an arrow quiver receiver 508 is shown mounted to bracket 500 via a set of screws 510. In this example, arrow quiver receiver 508, which is configured to facilitate the removable attachment of an arrow quiver thereto, is a known device manufactured by Kwikee Kwiver and is, therefore, not described in detail.

In this example, scope 112 is a red-dot reflector scope with a lighted reticle. Scope 112 includes a tubular body 512, a battery compartment 514, a reticle brightness dial 516, an elevation adjustment knob 518, and a windage adjustment knob 520. Scope 112 may be magnified or non-magnified. Scope 112 is mounted to the rest of adjustable bow sight 100 by a set of scope rings 522. Each of scope rings 522 includes a first-side portion 524 screwed to a second-side portion 526 at opposite ends of body 512 by a set of screws 528. First-side portions 524 are attached to a carrier 528 by a set of screws 530 such that scope 112 remains in a fixed position with respect to carrier 528 at all times during operation. Indeed, bracket 500, receiver 508, scope rings 522, and scope 112 all remain fixed with respect to carrier 528 during target distance adjustments.

Carrier 528 further includes a threaded hole 532 (shown in FIG. 7) having an adjustment screw 534 (shown in FIG. 6) disposed therein. Screw 534 is configured to urge against screw 530 during the mounting of first-side portion 524 of scope ring 522. Before screw 530 is tight, fine adjustments to the position of screw 530 with respect to carrier 528 are made by rotating screw 534. That is, rotating screw 534 clockwise causes screw 534 to urge screw 530, and therefore, scope ring 522 upward in channel 506. Likewise, rotating screw 534 counterclockwise causes screw 534 to back off screw 530, and therefore, allows scope ring 522 to be moved downward in channel 506. Once the position of scope ring 522 with respect to carrier 528 is satisfactory, screw 530 is tightened, thereby fixing scope ring 522 with respect to carrier 528.

Figure 7:
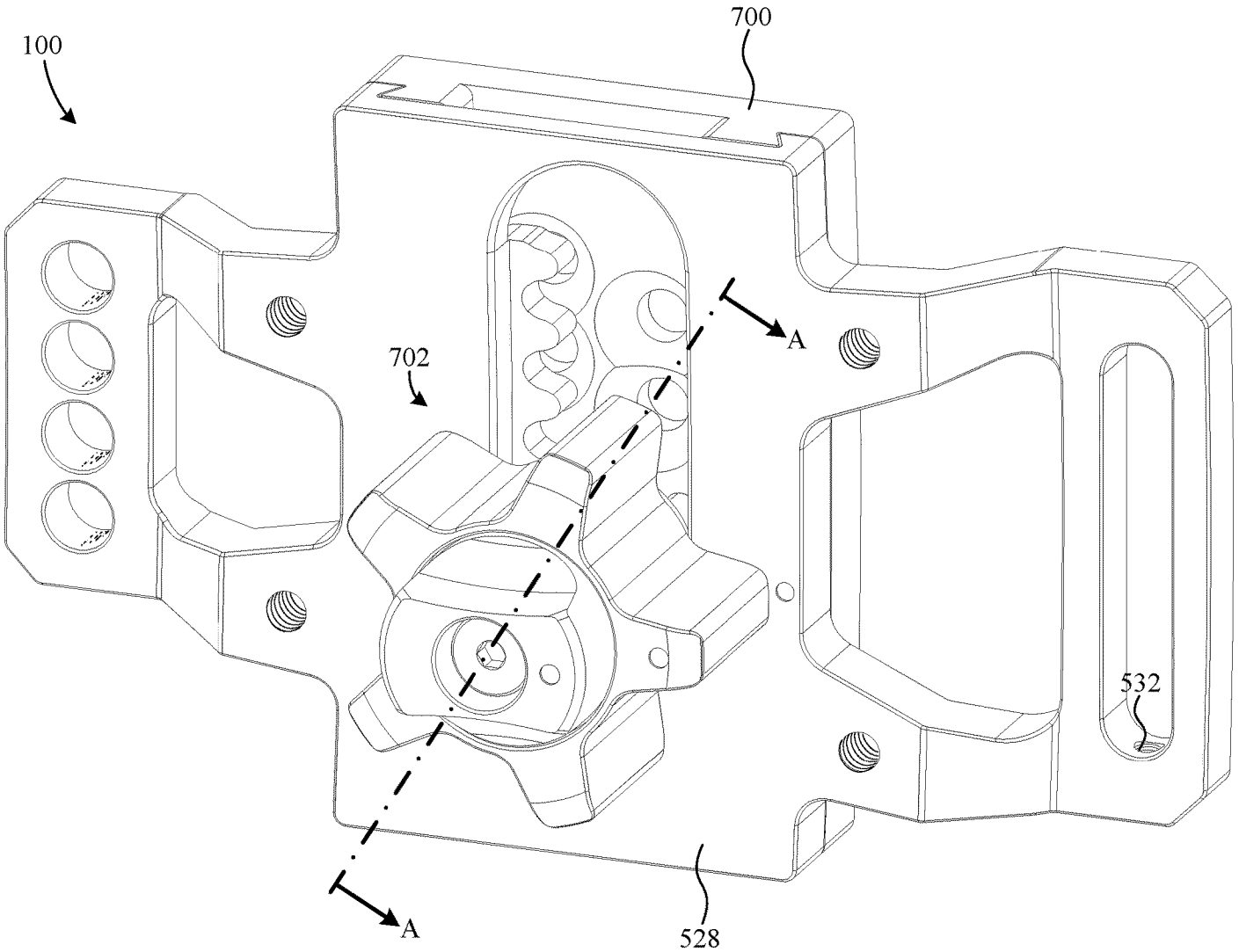
FIG. 7 is a second side perspective view of the adjustable bow sight of FIG. 1 with the scope and accessory bracket removed.

FIG. 7 shows a perspective view of adjustable bow sight 100 with bracket 500, scope rings 522, and screw 534 removed. In addition to carrier 528, adjustable bow sight 100 includes a base 700 and an adjustment mechanism assembly 702. Base 700 is configured to mount to riser 104 via a set of screws (not shown) and remain fixed with respect to riser 104 during adjustment by adjustment mechanism assembly 702. When being adjusted by adjustment mechanism assembly 702, the position of carrier 528 with respect to base 700 changes and, therefore, the position of scope 112 with respect to bow 102 changes.

Figure 8:
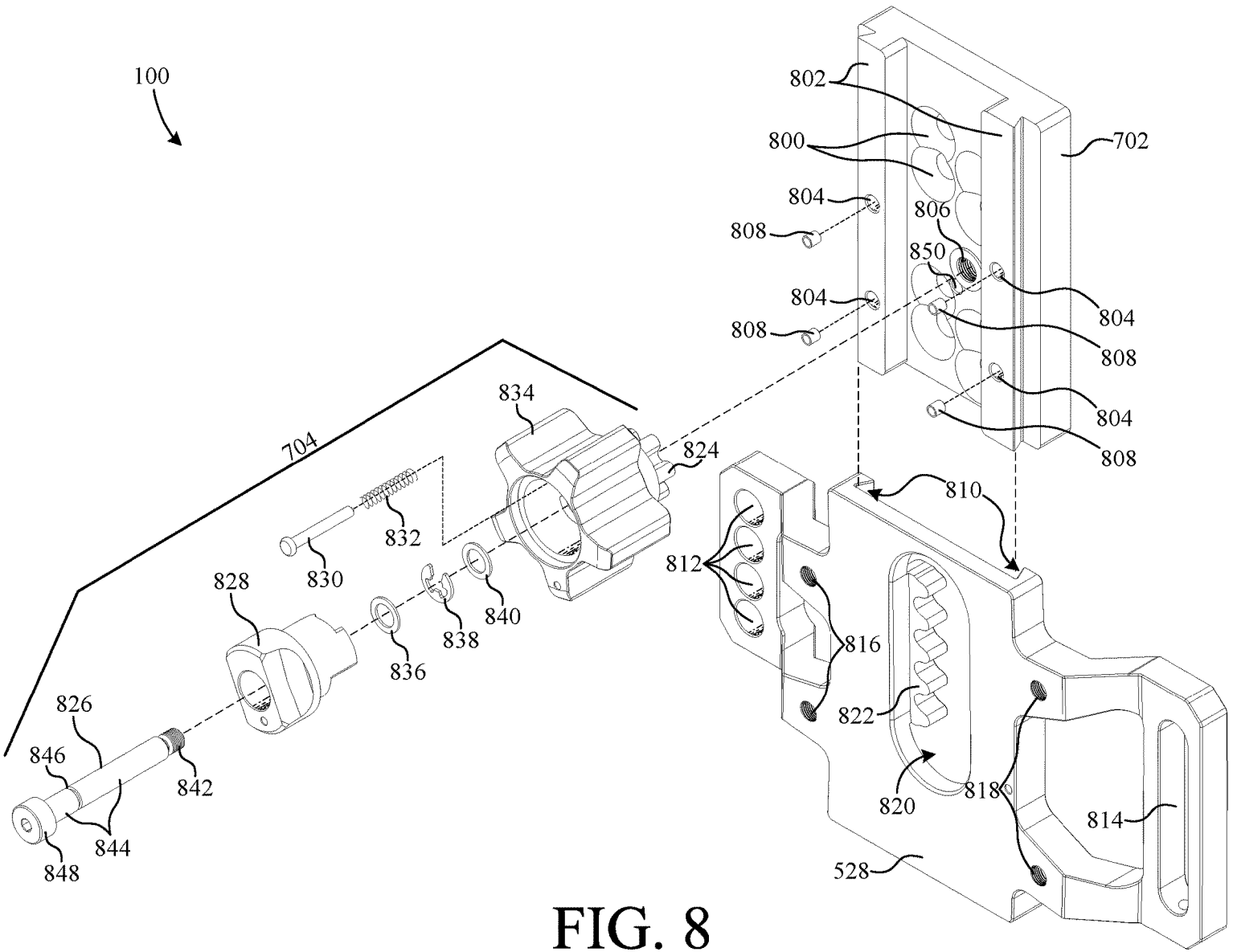
FIG. 8 is an exploded perspective view of the adjustable bow sight of FIG. 7.

FIG. 8 is an exploded, perspective view of carrier 528, base 702, and adjustment mechanism assembly 704. During assembly, base 702 mounts to riser 104 of bow 102, carrier 528 slidably mates with base 702, and adjustment mechanism assembly 704 is coupled to both base 702 and carrier 528.

Base 702 is a monolithic body machined from a billet of aluminum and includes eight countersunk holes 800, a guide 802, a plurality of bores 804, and a threaded hole 806. Countersunk holes 800 are configured to receive a set of two screws (not shown) that mount base 702 to riser 104. Although two screws are used to mount base 702 to riser 104, there are eight countersunk holes 800 formed in base 702 to accommodate for bow risers having different hole spacing between the two threaded holes that receive sight screws. By countersinking holes 800 and using complementary countersink screws to attach base 702 to riser 104, the screw heads do not protrude from the interior planar surface of base 702. This prevents the screw heads from impeding the movement of carrier 528 along guide portion 802. Each of bores 804 is formed through the top planar surface of guide 802 and each is configured to seat a respective detent 808. Detents 808 are spring-loaded ball detents configured to provide biasing between base 702 and carrier 528, but other types of detents including, but not limited to, resilient bumps, non-resilient bumps, rollers, and so on. Other functions of detents 808 will be discussed with reference to upcoming FIG. 10.

In this example, guide 802 is a male dovetail profile extending along a curved path. The curved path has a relatively large radius of curvature, which is approximately the same as the draw length of bow 102. The radius of curvature could be matched to the particular draw length of each archer. However, for the sake of manufacturing efficiency, the radius of curvature can be determined based on statistical data relating to the draw length of a particular group of archers. For example, the radius of curvature of a particular model can correspond to the average draw length of a group of adult males. As another example, the radius of curvature of another particular model can correspond to the average draw length of a group of youth archers. In any case, the radius of curvature is of a magnitude that exceeds the greatest dimension of adjustable bow sight 100.

Carrier 528 is a monolithic body machined from a billet of aluminum defining a guide follower 810, a column of holes 812, a slot 814, a first set of threaded holes 816, a second set of threaded holes 818, an opening 820, and a rack gear 822. Guide follower 810 is complementary to guide 802 of base 702 in that it is a channel defining a dovetail profile configured to slidably engage guide 802. Like guide 802, the dovetail profile of guide follower 810 extends along a curved path having a relatively large radius of curvature approximately the same as draw length of bow 102. Holes 812 are configured to receive one of screws 530 of scope rings 522. That is, each of holes 812 is discretely spaced apart in a vertical column to provide a different option in terms of where scope ring 522 can be fixed to carrier 528. Slot 814 is configured to receive the other one of screws 530. Because slot 814 is continuous along vertical path, screw 530 and, therefore, scope ring 522 can be positioned and tightened anywhere along slot 814. Threaded holes 816 are utility screw holes configured to receive complementary screws (i.e. screws 502) used to mount various types of accessories (i.e. bracket 500) to carrier 528. Likewise, threaded holes 818 are utility screw holes configured to receive complementary screws of various types of accessories (e.g., quiver receivers, brackets, vibration dampeners, lights, etc.) that are commonly mounted to bows. Rack gear 822 is a fixed part of carrier 528 and is configured to mesh with a complementary pinion gear 824 of adjustment mechanism assembly 704.

Adjustment mechanism assembly 704 facilitates the adjustment in position of carrier 528 along guide 802 of base 702. Assembly 704 further includes a shoulder screw 826, a lock knob 828, a lock pin 830, a spring 832, an adjustment knob 834, a first shim washer 836, a retaining clip 838, and a second shim washer 840. Shoulder screw 826 is configured to be fixed to base 702 and functions as an axle about which lock knob 828 and adjustment knob 834 rotate. Shoulder screw 826 includes a thread set 842, a cylindrical body 844, a groove 846, and a head 848. Thread set 842 is configured to thread snuggly into the complementary threads of threaded hole 806, so that shoulder screw 826 remains fixed with respect to base 702. Cylindrical body 844 is smooth and is disposed through lock knob 828 and adjustment knob 834. Groove 846 is configured to seat retaining clip 838, so that lock knob 828 and shim washer 836 are free to rotate about the portion of body 844 disposed between head 848 and groove 846 but are not free to move linearly along body 844. Shim washer 840 is also disposed around body 844 but between retaining clip 838 and adjustment knob 834. Lock knob 828 is configured to rotate between a first position and a second position. In the first position, adjustment knob 834 is free to rotate about screw 826 and, therefore, carrier 828 is free to move with respect to base 702. In the second position, lock knob 828 urges lock pin 830 into a complementary hole 850 of base 702, thereby preventing adjustment knob 834 from rotating about screw 826. Spring 832 urges lock pin 830 out of hole 850 when lock knob 828 is transitioned back to the unlocked, first position. Details of the locking feature of adjustment mechanism assembly 704 will be discussed in greater detail with reference to upcoming FIGS. 14A-14B.

Figure 9:
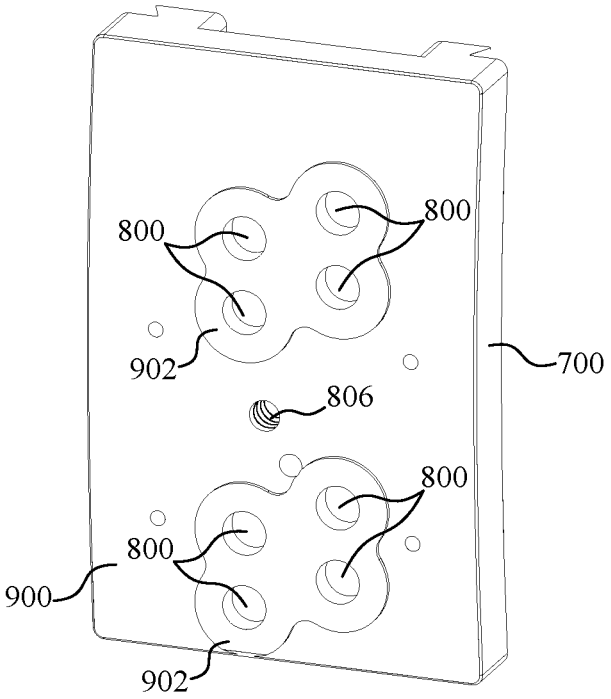
FIG. 9 is a perspective view of the base of the adjustable bow sight of FIG. 8.

FIG. 9 is a rear perspective view of base 700. As shown, the majority of the rear planar surface 900 of base 700 is recessed slightly to define raised, planar peripheral edges 902 around the backside of countersunk holes 800. By having surface 900 slightly below the planar surface of peripheral edges 902, rear planar surface 900 is less likely to engage non-planar riser features of various bows that could otherwise obstruct the square mounting of base 700 to a riser. In other words, peripheral edges 902 function as stand-offs that engage the riser of the host bow while preventing, or at least minimizing, contact between rear planar surface 900 and the riser.

Figure 10:
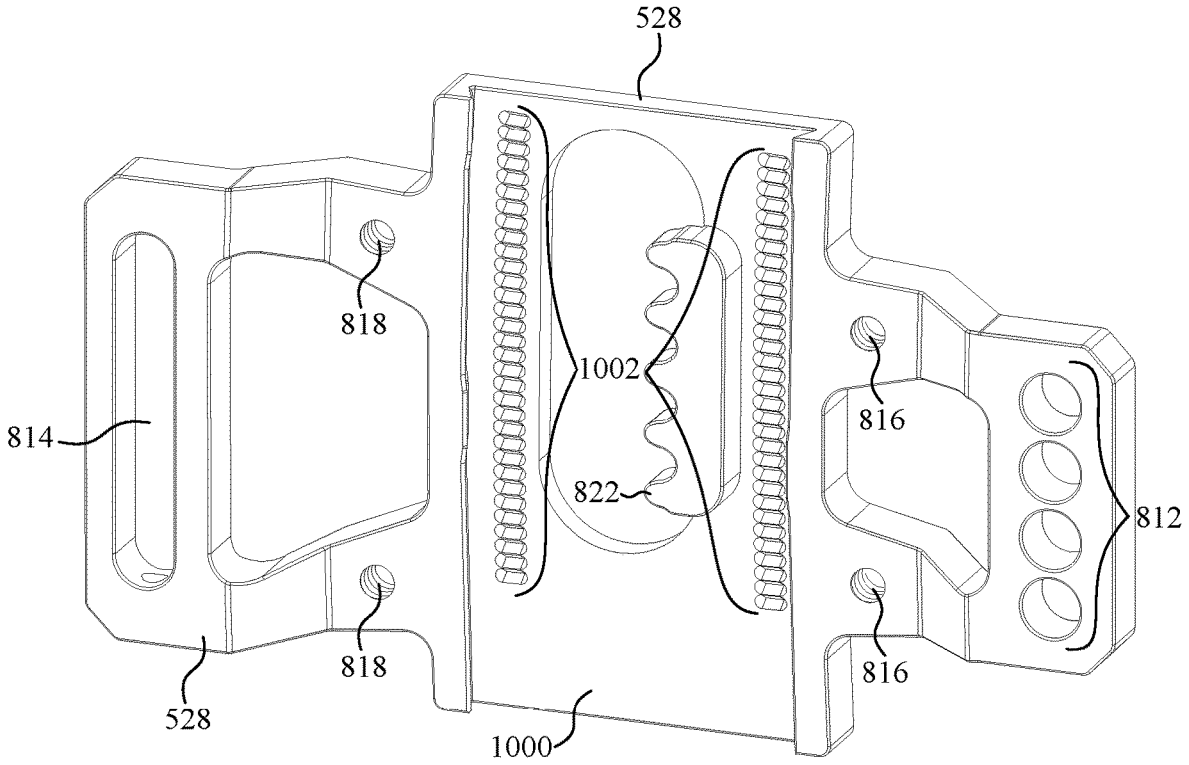
FIG. 10 is a perspective view of the carrier of the adjustable bow sight of FIG. 8.

FIG. 10 is a rear perspective view of carrier 528. As shown, the interior surface 1000 of carrier 528 further defines two columns of recesses 1002. Recesses 1002 are configured to selectively seat detents 808 such that a "click" occurs when carrier 528 is moved relative to base 702. Each "click" is indicative of a specific distance that carrier 528 has been moved when adjustment knob 824 is rotated. In this manner, carrier can be moved between a plurality of discrete, spaced-apart positions. Of course, each of these changes in relative position between carrier 528 and base 702 correspond to a respective change in target distance. For example, if adjustable bow sight 100 is zeroed at a 20 yard target distance, but the archer is shooting at target 30 yards away, the archer might rotate knob 834, for example, five "clicks", wherein each "click" increases the target distance by two yards. Accordingly, by rotating knob 834 ten "clicks", the reticle 302 might be moved from a 20 yard shot position to a 40 yard shot position. In this example, the spacing between each of recesses 1002 is the same. However, the spacing may optionally increase or decrease from one recess 1002 to the next at any suitable distance such that each "click" can represent any suitable increase in target distance which may, or may not, be linear.

Figure 11:
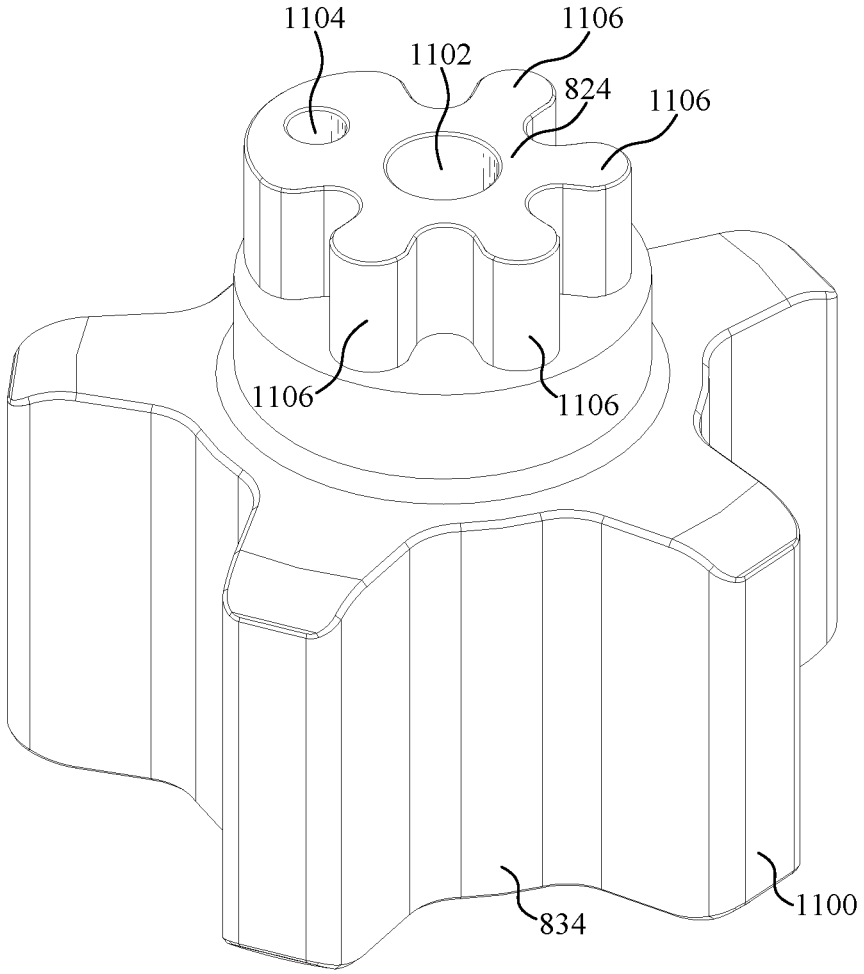
FIG. 11 is a perspective view of the adjustment knob of the adjustable bow sight of FIG. 8.

FIG. 11 is a rear perspective view of adjustment knob 834. Adjustment knob 834 is a monolithic part cut (e.g. machined) from Delrin® plastic and, in addition to pinion gear 824, includes a plurality of protrusions 1100, a first aperture 1102, and a second aperture 1104. Protrusions 1100 facilitate the gripping of adjustment knob 834 when adjustment knob 834 is rotated about screw 826. First aperture 1102 passes completely through the center of adjustment knob 834 and is configured to receive screw 826. Second aperture 1104 passes completely through adjustment knob 834, parallel to aperture 1102, but is slightly offset from the center of adjustment knob 834. Second aperture 1104 is adapted to receive pin 830 and provides a passage through which pin 830 extends when adjustment mechanism assembly 704 is in the locked position. When adjustment mechanism assembly 704 is in the unlocked position, pin 830 is retracted back into aperture 1104. As shown, pinion gear 824 includes four teeth 1106 and portion 1108 through which aperture 1104 passes through. The side (shown in FIGS. 14A and 14B) of adjustment knob 834, opposite pinion gear 824, defines a recess wherein locking knob 828 is disposed during assembly. Details related to this recess will be discussed in greater detail with reference to FIGS. 14A and 14B.

Figure 12:
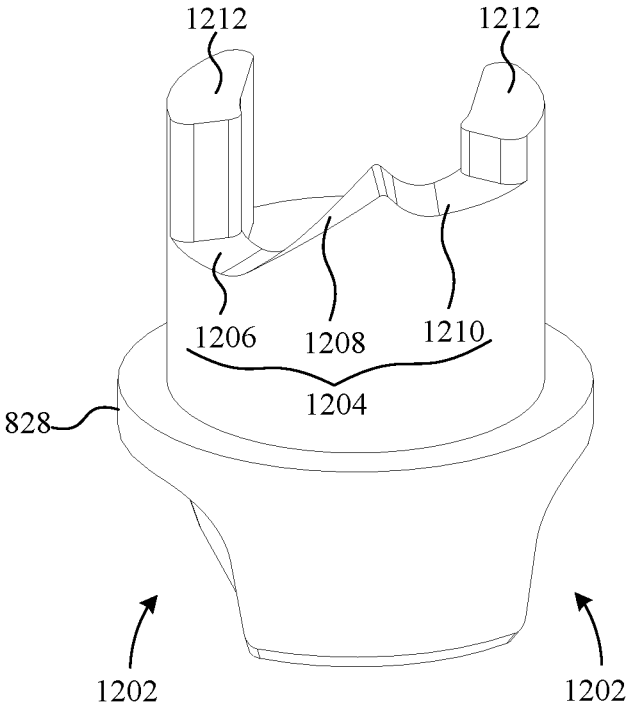
FIG. 12 is a perspective view of the locking knob of the adjustable bow sight of FIG. 8.

FIG. 12 is a rear perspective view of locking knob 828. Locking knob 828 is also a monolithic part cut (e.g. machined) from Delrin® plastic. Knob 828 includes an aperture 1200 (shown in FIGS. 14A-14B), a set of opposing cut-aways 1202, and a cam feature 1204. Aperture 1200 passes completely through knob 828 and is configured to receive screw 826. Accordingly, aperture 1200 has the same inner diameter as aperture 1102 of knob 834. Cut-aways 1202 facilitate the gripping of knob 828 so that knob 828 can be rotated by the archer. Cam feature 1204 is a surface formed about aperture 1200 that is configured to slidably engage the head of pin 830. Cam feature 1204 includes a first resting surface 1206, a ramped surface 1208, and a second resting surface 1210. When adjustment mechanism assembly 704 is in the unlocked position, the bulged head of pin 830 urges against first resting surface 1206. When adjustment mechanism assembly 704 transitions from the unlocked position toward the locked position by rotating knob 828, ramped surface 1208 urges the bulged head of pin 830 toward knob 834. Once the bulged head of pin 830 passes the highest point of ramped surface 1208, it urges against second resting surface 1210 and is held in position because the elevation of second resting surface 1210 is slightly below the highest point of ramped surface 1208. Knob 828 further includes a set of legs 1212 that protrude beyond cam feature 1204 to slidably engage knob 834.

Figure 13:
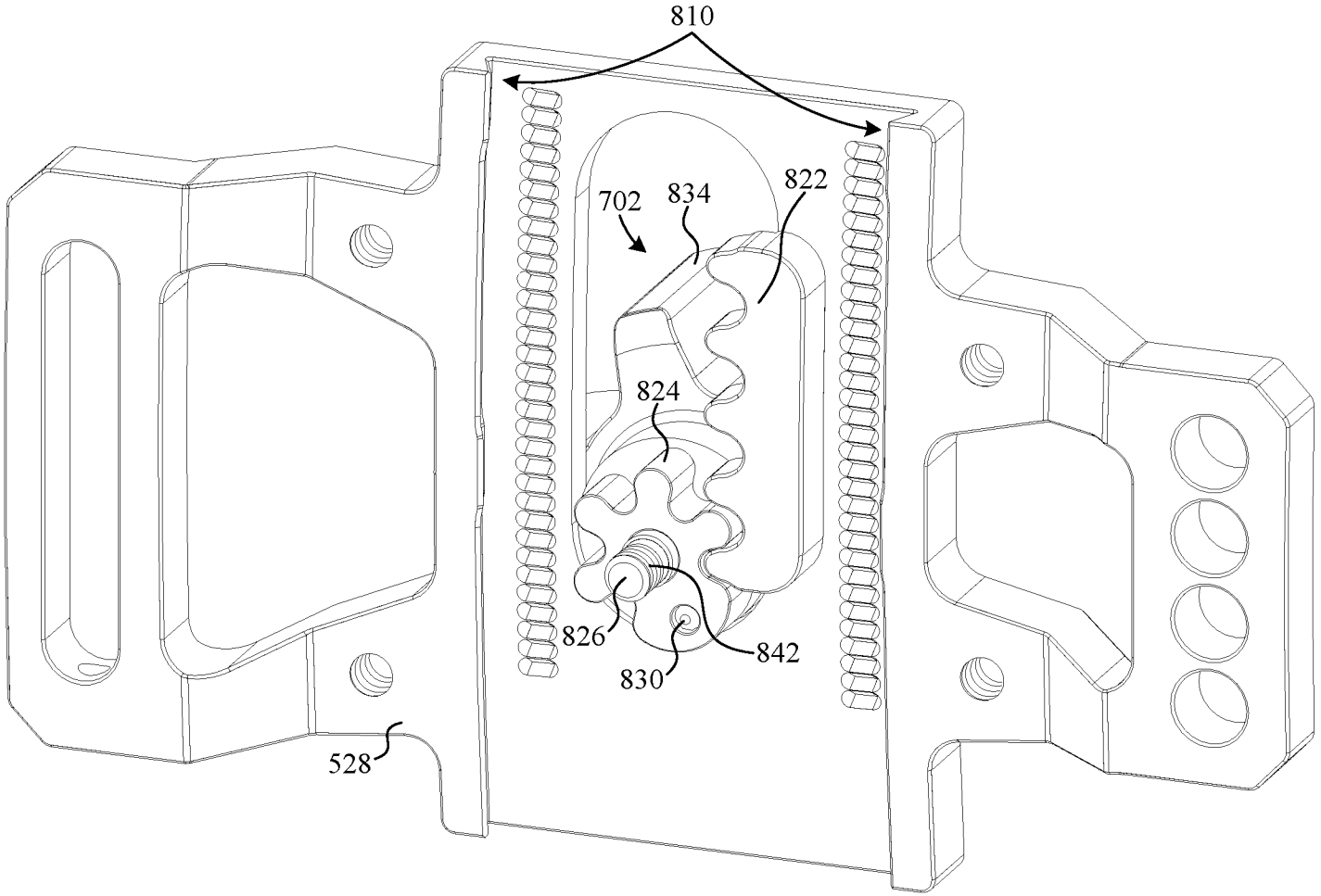
FIG. 13 is a perspective view of the adjustable bow sight of FIG. 8 assembled and with the base removed.

FIG. 13 shows another perspective view of adjustable bow sight 100 with base 702 removed to illustrate the mechanical relationship between adjustment mechanism assembly 702 and carrier 528. Although not shown, thread set 842 of screw 826 is fixed with respect to base 702, while adjustment knob 834 is rotatable about screw 826. Pinion gear 824 is meshed with rack gear 822, so that rotation of knob 834 causes carrier 528 to move with respect base 702 along guide follower 810. Of course, the direction (forward or reverse) in which carrier 528 moves along guide follower 810 is dictated by the direction (clock-wise or counter clock-wise) that knob 834 is rotated. In this example, pin 830 is shown in a retracted position wherein knob 834 and, therefore, pinion gear 824 are free to rotate about screw 826. However, when pin 830 protrudes from the bottom of pinion gear 824, it engages base 702 to prevent rotation of knob 834 about screw 826.

In this particular illustration, bow sight 100 is shown in the lowermost position, wherein bow sight 100 is positioned for the shortest distance to target. This shortest distance is dictated by archer preference. For example, the archer may choose to "zero in" scope 112 at twenty yards when bow sight 100 is in the lowermost position. This would allow the archer to shoot at any target that is twenty yards or closer without having to make an adjustment. Then, if the archer chooses to shoot at a target that is at a greater distance, they may rotate knob 834 accordingly. For example, a thirty yard target distance might require rotating knob 824 five "clicks". As previously mentioned, each "click" changes the position of carrier 528 with respect to base 702 by some increment. Those skilled in the art know that the specific degree to which each "click" changes the distance to target will vary from one archer to the next because the specifications (e.g., draw weight, draw length, arrow weight, let-off, etc.) of both the bow and arrow vary from one archer to the next. For example, an archer shooting an arrow at 300 ft/sec may see a two yard increase in the distance to target for each "click", while an archer shooting an arrow at 200 ft/sec may see a three yard increase in the distance to target for each "click". In other words, the precision of each "click" increases as arrow speed increase.

Figure 14A:
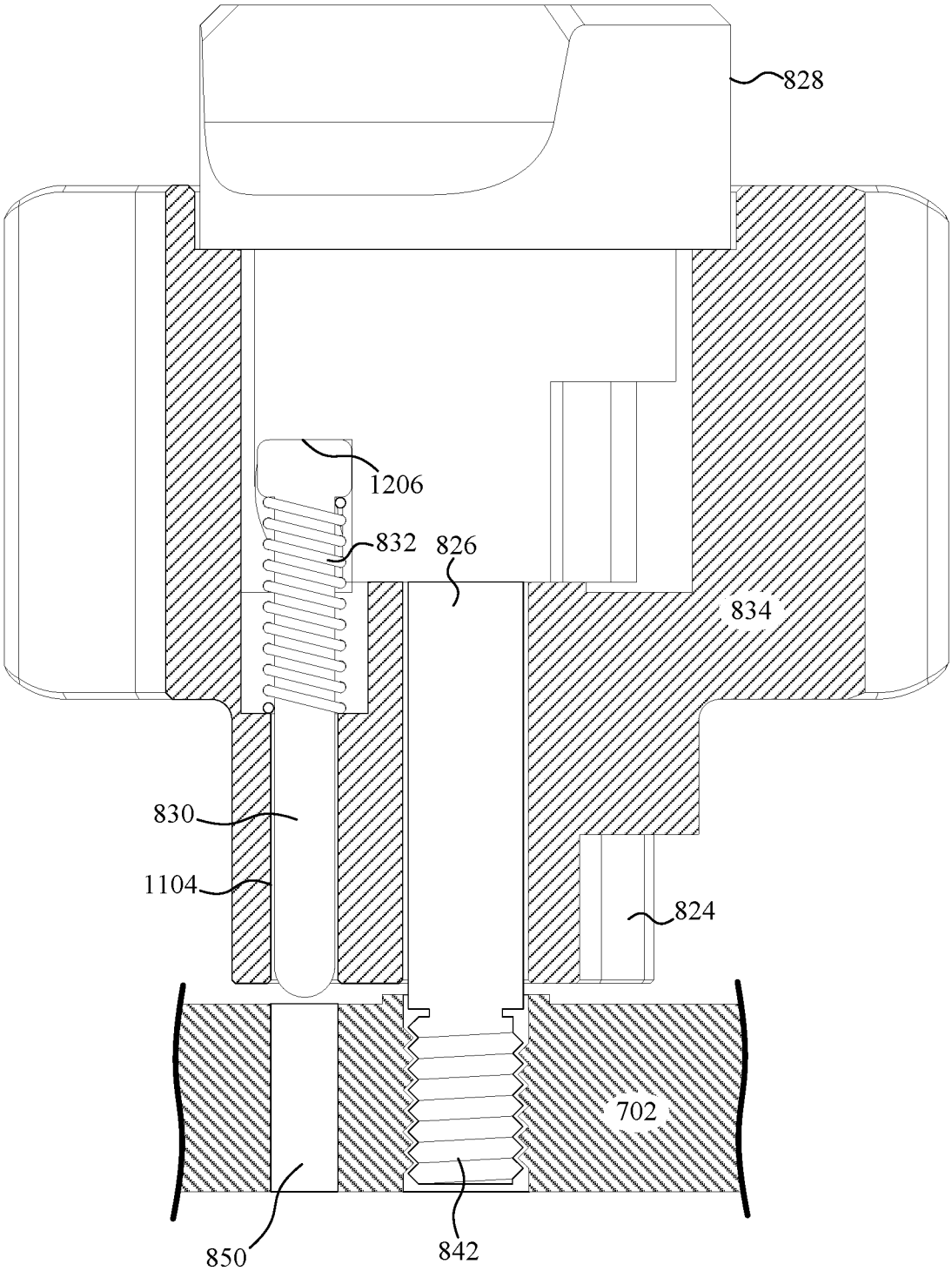
FIG. 14A is a partially cross-sectioned view taken along Line A-A of FIG. 7 of the base and adjustment knob of the adjustable bow sight of FIG. 7 in an unlocked position.

FIG. 14A is a cross-sectional view of knob 834 and base 702 taken along line A-A of FIG. 7 with knob 828 turned to the unlocked position. In the unlocked position, the bulged head of pin 830 abuts resting surface 1206 of cam feature 1204 of knob 828. With the bulged head of pin 830 abutting resting surface 1206, pin 830 is retracted into hole 1104 of knob 834 and, therefore, from hole 850 of base 702, so that knob 834 is free to rotate about screw 826. Although spring 832 is mostly decompressed when pin 803 is retracted into hole 1104 of knob 828, spring 832 is still slightly compressed sufficient to maintain slidable engagement between the bulged head of pin 803 and cam feature 1204.

Figure 14B:
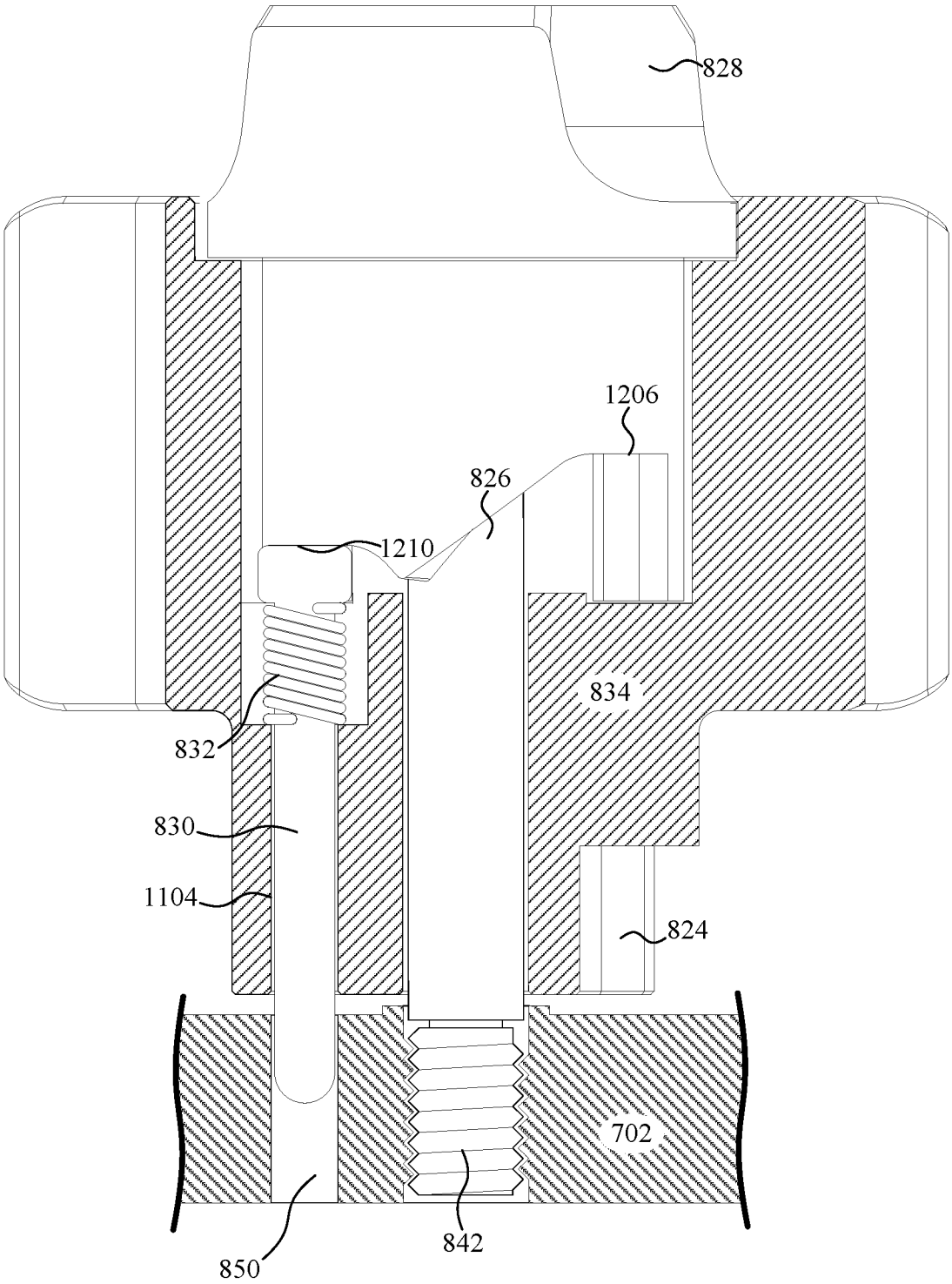
FIG. 14B is a partially cross-sectioned view taken along Line A-A of FIG. 7 of the adjustable bow sight of FIG. 7 in a locked position.

FIG. 14B is a cross-sectional view of knob 834 and base 702, taken along line A-A of FIG. 7, with knob 828 turned to the locked position. In the locked position, the bulged head of pin 830 abuts resting surface 1210 of cam feature 1204 of knob 828. With the bulged head of pin 830 abutting resting surface 1210, pin 830 is protrudes from hole 1104 of knob 834 and, therefore, into hole 850 of base 702 such that knob 834 cannot rotate about screw 826. As shown, spring 832 is mostly compressed when the bulged head of pin 830 is urged against resting surface 1210 of cam feature 1204. One benefit to locking adjustment mechanism assembly 702 is that carrier 528 will not inadvertently move with respect to base 702. This is particularly advantageous when carrying bow 102 through rough terrain, because it prevents scope 112 from getting knocked around and prevents premature wear on adjustable bow sight 100.

Figure 15A:
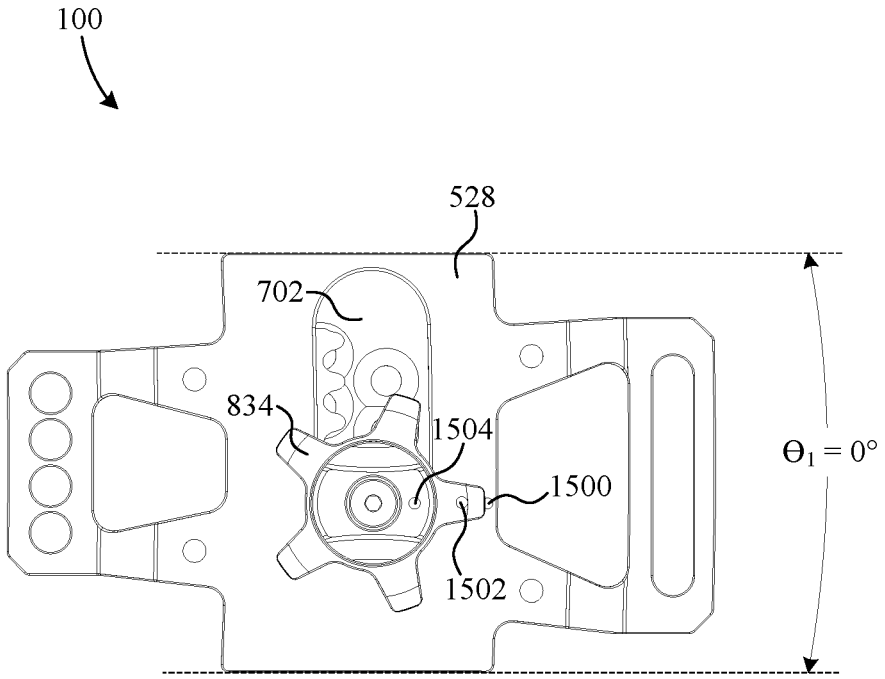
FIG. 15A is a plan view of the adjustable bow sight of FIG. 8 with the carrier in an uppermost position.

FIG. 15A shows a side view of adjustable bow sight 100 in an uppermost position wherein the angle θ between carrier 528 and base 702 is zero degrees. In the uppermost position, adjustable bow sight 100 is configured for a shot having a minimum target distance. The displacement of carrier 528 with respect to base 702 can be defined as zero when adjustable bow sight 100 is in the uppermost position.

As shown, each of carrier 528, knob 834, and knob 828 includes a respective alignment indicia 1500, 1502, and 1504. Indicia 1500 is depression formed in carrier 528, indicia 1502 is a depression formed in knob 834, and indicia 1504 is a depression formed in knob 828. The alignment of indicia 1500 and 1502 indicates that carrier 528 is at the uppermost position with respect to base 702. The alignment of indicia 1504 with indicia 1502 indicates that knob 828 is in the unlocked position.

Figure 15B:
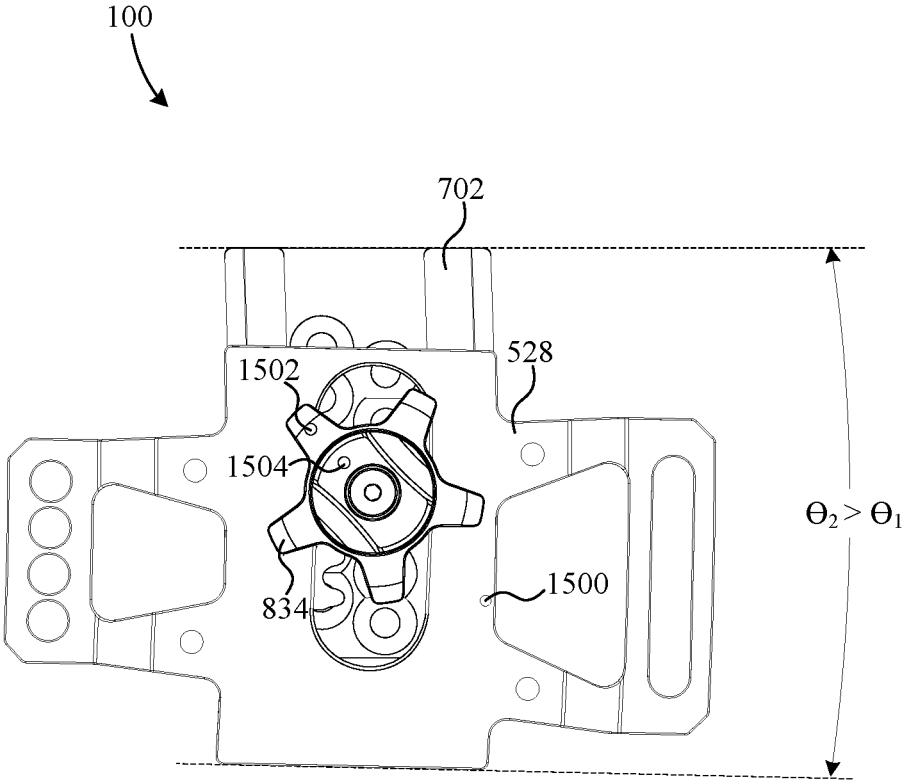
FIG. 15B is a plan view of the adjustable bow sight of FIG. 8 with the carrier in an intermediate position between an uppermost position and a lowermost position.

FIG. 15B shows a side view of adjustable bow sight 100 in an intermediate position, between an uppermost position and a lowermost position, wherein the angle θ between carrier 528 and base 702 is greater than zero degrees. Likewise, the position and/or orientation of carrier 528 is changed with respect to base 702 to some degree when adjustable bow sight 100 is in between a lowermost position and an uppermost position. In this intermediate position, adjustable bow sight 100 is configured for a shot that is in between a minimum target distance and a maximum target distance of bow sight 100. As shown, indicia 1500 and 1502 are not aligned which, as previously mentioned, indicates that carrier 528 is not in the uppermost position.

Figure 15C:
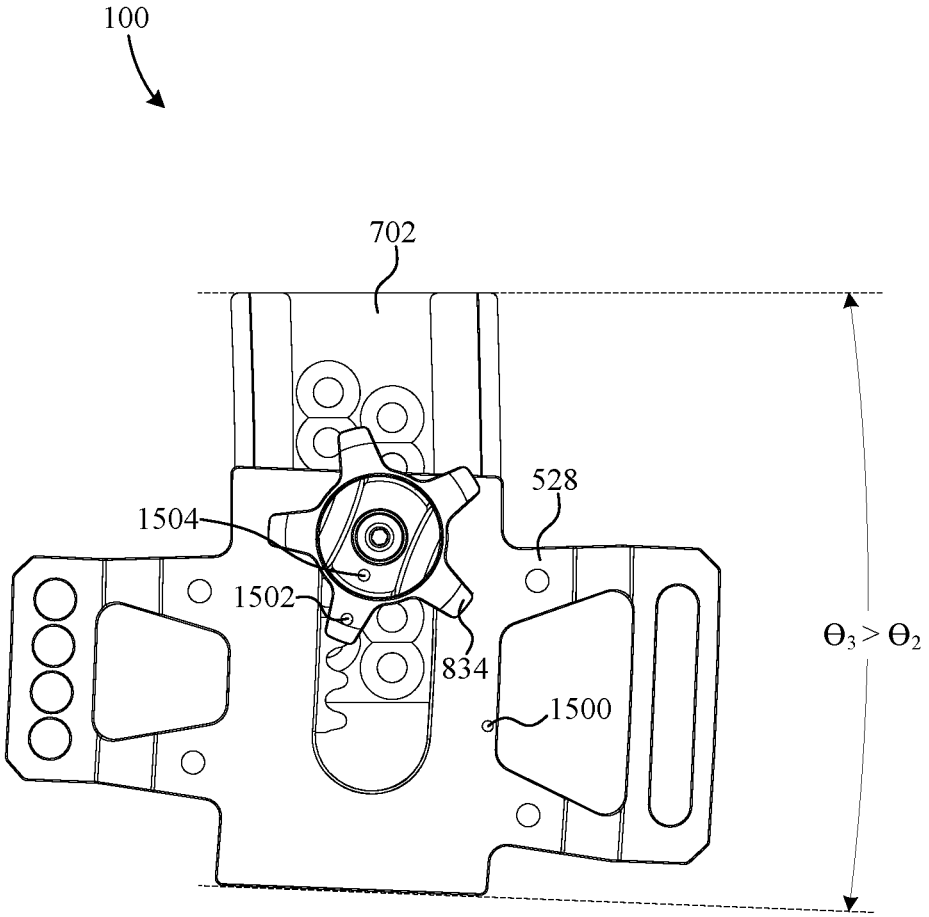
FIG. 15C is a plan view of the adjustable bow sight of FIG. 8 with the carrier in a lowermost position.

FIG. 15C shows a side view of adjustable bow sight 100 in a lowermost position wherein the angle θ between carrier 528 and base 702 is at the maximum extrema. Likewise, the displacement and change in orientation of carrier 528 with respect to base 702 is maximized when carrier 528 is in the lowermost position. In this position, adjustable bow sight 100 is configured for a shot that is at the maximum target distance of bow sight 100.

Figure 16A:
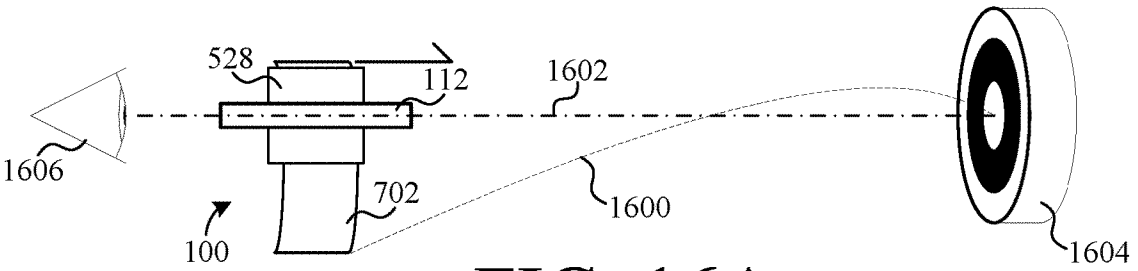
FIG. 16A illustrates the relationship between arrow trajectory, the line of sight, and the orientation of the base of the adjustable bow sight of FIG. 1, when the sight (optical axis or pin tip) is aligned with the line of sight at short range.

FIG. 16A illustrates the relationship between arrow trajectory, the line of sight, and the orientation of the base 702, when the sight (e.g., scope 112) is aligned with an archer's line of sight 1600 at short range, with adjustable bow sight 100 in the uppermost position. As previously mentioned, the angle θ between base 702 and carrier 528 is zero when adjustable bow sight 100 is in the uppermost position. Line of sight 1602 is defined by a straight line between target 1604 and the archer's eye 1606. Scope 112 and, therefore, bow 102 are positioned so that the optical axis 114 of scope 112 is in the line of sight 1602.

Figure 16B:
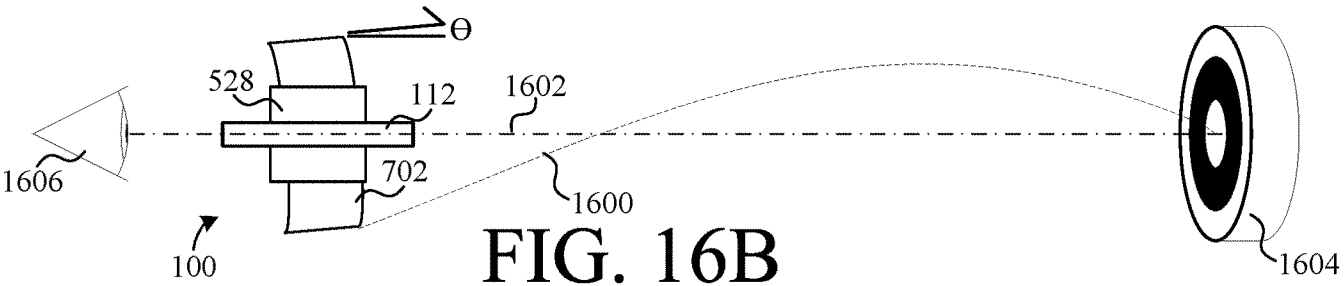
FIG. 16B illustrates the relationship between arrow trajectory, the line of sight, and the orientation of the base of the adjustable bow sight of FIG. 1, when the sight (optical axis or pin tip) is aligned with the line of sight at intermediate range.

FIG. 16B illustrates the relationship between arrow trajectory, line of sight 1602, and the orientation of base 702, when scope 112 is aligned with line of sight 1602 with adjustable bow sight 100 in an intermediate position. In the intermediate position, the angle θ between base 702 and carrier 528 is greater than zero, and scope 112 remains positioned in and aligned with line of sight 1602. As a result, the position of base 702 and bow 102 with respect to the archer's eye 1606 changes when the target distance increases, but the position of carrier 528 and scope 112 with respect to the archer's eye 1606 remains the same.

Figure 16C:
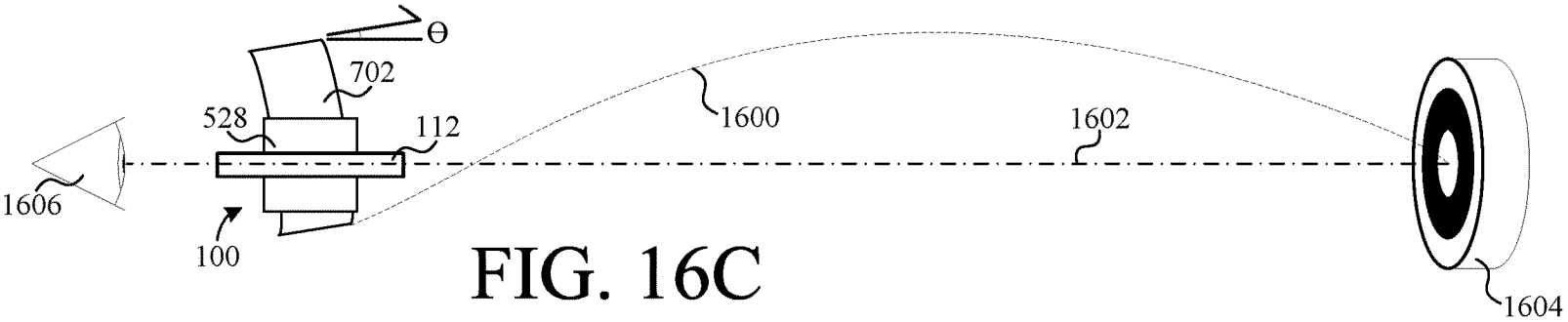
FIG. 16C illustrates the relationship between arrow trajectory, the line of sight, and the orientation of the base of the adjustable bow sight of FIG. 1, when the sight (optical axis or pin tip) is aligned with the line of sight at long range.

FIG. 16C illustrates the relationship between arrow trajectory, line of sight 1602, and the orientation of base 702, when scope 112 is aligned with line of sight 1602, with bow sight 100 in the lowermost position. In the lowermost position, the angle θ between base 702 and carrier 528 is greater than zero, and scope 112 remains positioned in and aligned with line of sight 1602. Again, the position of base 702 and bow 102 with respect to the archer's eye 1606 changes when the target distance increases, but the position of carrier 528 and scope 112 with respect to the archer's eye 1606 remains the same.

The description of particular embodiments of the present invention is now complete. Many of the described features may be substituted, altered or omitted without departing from the scope of the invention. For example, alternate scopes (e.g. traditional tube scope, illuminated tube scope, etc.), may be substituted for scope 112. As another example, components of adjustable bow sight 100 may be manufactured from different materials and processes such as, for example, injected molded plastics. These and other deviations from the particular embodiments shown will be apparent to those skilled in the art, particularly in view of the foregoing disclosure.

We claim:

1. An adjustable bow sight mount comprising:

a base configured to be coupled in a fixed position on a first side of a riser of a bow, said base defining a guide, said guide having a first portion disposed along a front edge of said base and a second portion disposed along a rear edge of said base, said base defining a fastening aperture configured to receive a fastener for attaching said base to said riser, said fastening aperture disposed between said first portion of said guide and said second portion of said guide and extending along a first axis;

a shaft coupled to said base between said first portion of said guide and said second portion of said guide, said shaft extending along a second axis parallel to said first axis;

a pinion mounted on said shaft, said pinion being rotatable about said second axis;

a sight mount configured to facilitate the attachment of a sight thereto, said sight mount at least partially determining a position of a line of sight through said sight, said sight mount including a first scope ring disposed on a second side of said riser opposite said first side of said riser and forward of said riser, said sight mount additionally including a second scope ring disposed on said second side of said riser and rearward of said riser; and a carrier movably coupled to said base and coupled to said sight mount, said carrier defining a follower having a first portion slidably engaged with said first portion of said guide and a second portion slidably engaged with said second portion of said guide, said guide facilitating movement of said carrier along a path with respect to said base and said shaft, said carrier defining an opening and a rack, said shaft being disposed through said opening, and said rack being meshed with said pinion.

2. The adjustable bow sight mount of claim 1, wherein:

said pinion gear is fixed to an adjustment knob; and said carrier moves with respect to said base responsive to rotating said adjustment knob.

3. The adjustable bow sight of claim 1, wherein at least one of said guide and said follower includes a track extending along a curved path.

4. The adjustable bow sight of claim 1, wherein said carrier is selectively movable between a plurality of spaced-apart, discrete positions with respect to said base.

5. The adjustable bow sight of claim 4, wherein:

one of said carrier and said base includes a detent;

the other of said carrier and said base includes a plurality of valleys positioned and configured to selectively engage said detent; and each valley of said plurality of valleys corresponds to a respective one of said spaced-apart, discrete positions.

6. The adjustable bow sight of claim 1, wherein said base includes a plurality of countersunk holes configured to receive a respective plurality of countersunk screws, said plurality of countersunk screws being configured to thread into a respective plurality of threaded holes formed in said riser of said bow.

7. The adjustable bow sight of claim 1, wherein:

said shaft is fixed to said base and remains stationary with respect to said base when said carrier is moved along said path with respect to said base;

said knob is coupled to said shaft, said knob being rotatable about said second axis;

said pinion is fixed to said knob;

said rack is fixed to said carrier and is configured to mesh with said pinion;

said carrier and said rack advance along said path in a first direction responsive to rotating said pinion clockwise about said second axis; and said carrier and said rack advance along said path in a second direction responsive to rotating said pinion counterclockwise about said second axis.

8. The adjustable bow sight of claim 7, wherein:

said first portion and said second portion of said guide are formed integrally with said base; and said first portion and said second portion of said follower are formed integrally with said carrier.

9. The adjustable bow sight of claim 7, further comprising a locking mechanism configured to selectively transition between a locked position and an unlocked position, the position of said pinion being fixed with respect to said rack gear when said locking mechanism is in said locked position, and said pinion being free to rotate about said shaft axis when said locking mechanism is in said unlocked position.

10. The adjustable bow sight of claim 1, further comprising a locking mechanism, and wherein:

said locking mechanism including a cam, a pin, and a biasing member;

said pin is seated in a bore in said knob;

said cam includes a handle end that facilitates rotation of said cam by a user;

said cam includes a cam surface that urges against an end of said pin;

said biasing member urges said pin into a retracted position within said bore; and rotation of said cam urges said pin into an extended position from said bore and into a complementary bore in said base, thereby preventing rotation of said knob with respect to said base.

11. The adjustable bow sight of claim 1, wherein:

said first portion of said guide and said second portion of said guide together form a portion of a dovetail rail; and said first portion of said follower and said second portion of said follower form a complementary portion of said dovetail rail.

12. The adjustable bow sight of claim 1, wherein engagement of said guide with said follower prevents movement of said follower away from said base in a direction parallel to said second axis.

13. The adjustable bow sight of claim 1, wherein:

said base is a monolithic structure; and said carrier is a second monolithic structure.

14. An adjustable bow sight, comprising:

a base configured to be coupled to a first side of a bow riser, said base including a guide extending along an arcuate path, said guide including a first guide edge disposed at a rear side of said base and a second guide edge disposed at a front side of said base;

a knob coupled to said base between said first guide edge and said second guide edge, said knob being rotatable about a first axis passing through said base, said first axis 6 being fixed with respect to said base;

a pinion coupled to said knob, said pinion operative to rotate about said first axis responsive to rotation of said knob; and a carrier movably coupled to said base, said carrier including a first follower slidably engaging said first guide edge to facilitate movement of said carrier along said arcuate path, a second follower slidably engaging said second guide to facilitate movement of said carrier along said arcuate path, an opening in said carrier, through which said knob is coupled to said pinion, a rack fixed with respect to said carrier and meshed with said pinion such that rotation of said pinion causes said carrier to move along said arcuate, a first sight mount coupled to a front side of said carrier and extending from said first side of said bow riser to a second side of said bow riser in front of said bow riser; and a second sight mount coupled to a rear side of said carrier and extending from said first side of said bow riser to said second side of said bow riser behind said riser.

* * * * *